US011603509B2

(12) United States Patent
Ceulemans et al.

(10) Patent No.: US 11,603,509 B2
(45) Date of Patent: Mar. 14, 2023

(54) ACIDIC HARD SURFACE CLEANERS COMPRISING ALKYLPYRROLIDONES

(71) Applicant: The Procter & Gamble Company, Cincinnati, OH (US)

(72) Inventors: Raphael Angeline Alfons Ceulemans, Holsbeek (BE); Stefanos Kantaridis, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/387,567

(22) Filed: Apr. 18, 2019

(65) Prior Publication Data

US 2019/0330568 A1 Oct. 31, 2019

(30) Foreign Application Priority Data

Apr. 27, 2018 (EP) ..... 18169816
Jan. 9, 2019 (EP) ..... 19150895

(51) Int. Cl.

| | |
|---|---|
| ***C11D 3/28*** | (2006.01) |
| ***C11D 1/83*** | (2006.01) |
| ***C11D 3/20*** | (2006.01) |
| ***C11D 3/37*** | (2006.01) |
| ***C11D 3/48*** | (2006.01) |
| ***C11D 11/00*** | (2006.01) |

(52) U.S. Cl.

CPC ..... *C11D 3/28* (2013.01); *C11D 1/83* (2013.01); *C11D 3/2079* (2013.01); *C11D 3/2082* (2013.01); *C11D 3/2086* (2013.01); *C11D 3/3723* (2013.01); *C11D 3/48* (2013.01); *C11D 11/0023* (2013.01)

(58) Field of Classification Search

CPC .. C11D 17/00; C11D 3/28; C11D 1/83; C11D 3/2079; C11D 3/2082; C11D 3/2086; C11D 3/3723; C11D 3/48; C11D 11/0023; C11D 3/0047; C11D 3/2075; C11D 1/86; C11D 1/835; C11D 11/0029; C11D 1/58; C11D 1/662; C11D 1/72; C09K 7/02; C23G 1/088

See application file for complete search history.

(56) References Cited

U.S. PATENT DOCUMENTS 4,533,485 A 8/1985 Oconnor et al.
5,032,296 A * 7/1991 Patel ..... C09K 8/24 507/206
5,252,245 A 10/1993 Garabedian, Jr.
5,468,423 A 11/1995 Garabedian, Jr.
5,503,778 A 4/1996 Liu et al.
5,641,742 A 6/1997 Adamy
5,736,496 A 4/1998 Durbut
5,962,388 A 10/1999 Sherry
6,113,655 A 9/2000 Tsunetsugu et al.
6,124,253 A 9/2000 Vinci
6,140,288 A 10/2000 Durbut
6,211,132 B1 4/2001 Pierce
6,328,816 B1 * 12/2001 Carlson ..... C11D 1/004 134/2
6,337,311 B1 1/2002 Durbut
6,399,563 B1 6/2002 Durbut
6,432,897 B1 8/2002 Cable
7,314,852 B1 1/2008 Cummings
7,417,000 B2 8/2008 Barnabas
7,470,656 B2 * 12/2008 Sherry ..... C11D 17/049 510/438
7,745,384 B2 6/2010 Perry
8,114,223 B2 2/2012 Brueckner
8,598,104 B2 12/2013 Kaiser
2005/0113277 A1 * 5/2005 Sherry ..... A47L 13/256 510/438
2007/0037721 A1 * 2/2007 Michels ..... C11D 7/265 510/295
2010/0160201 A1 * 6/2010 Scheuing ..... C11D 1/83 510/180
2010/0294310 A1 11/2010 Kaiser
2011/0150817 A1 * 6/2011 Woo ..... C11D 3/50 424/76.21
2013/0025073 A1 * 1/2013 Souter ..... C11D 3/38663 510/393

(Continued)

FOREIGN PATENT DOCUMENTS

CN 102167960 B * 7/2014 ..... A01N 25/24
DE 102013281225 A1 3/2015
WO 9422996 A1 10/1994

(Continued)

OTHER PUBLICATIONS

Google Patents translation of CN-102167960-B (Year: 2021).*
Extended European Search Report; Application No. 18169816.8-1105; dated Oct. 15, 2018; 7 pages.
All Office Actions; U.S. Appl. No. 16/387,566.
Extended European Search Report Application Ser. No. 19150895.1; dated Jul. 4, 2019; 8 pages.

*Primary Examiner* — Gregory R Delcotto
*Assistant Examiner* — Preeti Kumar
(74) *Attorney, Agent, or Firm* — Carolyn S. Powell; Andrew J. Mueller

(57) ABSTRACT

The need for an acidic liquid hard surface cleaning composition which provides improved removal of grease residues, while still being effective at removing limes-scale, is met by formulating an acidic liquid hard surface cleaning composition with an alkyl pyrrolidone, and additional nonionic surfactant selected from the group consisting of: alkoxylated nonionic surfactant, alkyl polyglucoside, and mixtures thereof, while limiting the amount of anionic surfactant present.

10 Claims, No Drawings

(56) References Cited

U.S. PATENT DOCUMENTS

2019/0330567 A1 10/2019 Ceulemans

FOREIGN PATENT DOCUMENTS

| | | | | | |
|---|---|---|---|---|---|
| WO | WO9423003 | A1 | | 10/1994 | |
| WO | WO9521238 | A1 | | 8/1995 | |
| WO | 9705222 | A1 | | 2/1997 | |
| WO | 02090483 | A2 | | 11/2002 | |
| WO | WO2004074417 | A1 | | 9/2004 | |
| WO | WO-2006078541 | A1 | * | 7/2006 | ..... A61K 8/11 |

* cited by examiner

ACIDIC HARD SURFACE CLEANERS COMPRISING ALKYLPYRROLIDONES

FIELD OF THE INVENTION

The present invention relates to acidic liquid compositions for cleaning a variety of hard surfaces such as hard surfaces found in around the house, such as bathrooms, toilets, garages, driveways, basements, gardens, kitchens, etc., the acidic liquid compositions being particularly effective at removing grease stains, including greasy soap scum and grease residue found around the kitchen.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible.

Limescale deposits, are formed due to the fact that tap water contains a certain amount of solubilised ions, which upon water evaporation eventually deposit as salts such as calcium carbonate on hard surfaces. The visible limescale deposits result in an unaesthetic aspect of the surfaces. The limescale formation and deposition phenomenon is even more acute in places where water is particularly hard. Furthermore, limescale deposits are prone to combination with other types of soils, such as soap scum or grease, and can lead to the formation of limescale-soil mixture deposits (limescale-containing soils). The removal of limescale deposits and limescale-containing soils is herein in general referred to as "limescale removal" or "removing limescale".

Typically, acid cleaners have been used to remove such limescale-based stains. However, such acid based cleaners are have typically been less effective at removing grease residue found around the kitchen.

Hence, a need remains for an acidic hard surface cleaning composition which is more effective at removing grease residues, while still being effective at removing limes-scale and greasy soap scum.

WO2004/074417 A relates to an aqueous acidic antimicrobial cleaning composition suitable for the hygienic cleaning of surfaces, which composition comprises an acid, an amine oxide surfactant, and an N-alkylpyrrolidone derivative. U.S. Pat. Nos. 6,140,288 and 6,337,311 relate to an all purpose liquid cleaning composition containing a nonionic surfactant, a liquid crystal suppression additive and water. U.S. Pat. No. 5,736,496 relates to an all purpose cleaning or microemulsion composition which contains an analephotropic negatively charged complex, a hydrocarbon ingredient, a Lewis base, neutral polymer, a cosurfactant, and water. WO9521238 relates to a microemulsion compositions or all purpose hard surface cleaning composition which contains an anticorrosion system designed to protect acid sensitive surfaces from attack by acidic materials. US20100294310 relates to a detergent composition comprising a hydrophobic polymer, a sulphonated polyacrylate, a pyrrolidone derivative and an anionic surfactant. U.S. Pat. No. 5,641,742 relates to a microemulsion composition containing, by weight: 1% to 20% of an anionic surfactant, 0.1 to 50% of an n-alkyl pyrrolidone cosurfactant; 0% to 10% of the nonionic surfactant; 0% to 5% of a fatty acid; 0.4% to 10% of perfume or a hydrocarbon and the balance being water.

SUMMARY OF THE INVENTION

The present invention relates to an acidic liquid hard surface cleaning composition comprising: a surfactant system, wherein the surfactant system comprises: an alkyl pyrrolidone, an additional nonionic surfactant selected from the group consisting of: alkoxylated nonionic surfactant, alkyl polyglucoside, and mixtures thereof, and less than 3.5 wt % of the composition of anionic surfactant; and an organic acid system, wherein the acidic liquid hard surface cleaning composition has a pH of less than 7.0, measured on the neat composition, at 25° C.

The present invention further relates to a method of cleaning a hard surface, preferably for removing grease residues from a hard surface, comprising the step of applying an acidic hard surface cleaning composition described herein to the hard surface.

The present invention further relates to the use of an alkyl pyrrolidone in an acidic hard surface cleaning composition for removing grease residues from a hard surface.

DETAILED DESCRIPTION OF THE INVENTION

Acidic hard surface cleaning compositions as described herein are more effective at removing grease residues, while still being effective at removing limes-scale.

As defined herein, "essentially free of" a component means that no amount of that component is deliberately incorporated into the respective premix, or composition. Preferably, "essentially free of" a component means that no amount of that component is present in the respective premix, or composition.

As used herein, "isotropic" means a clear mixture, having little or no visible haziness, phase separation and/or dispersed particles, and having a uniform transparent appearance.

As defined herein, "stable" means that no visible phase separation is observed for a composition kept at 25° C. for a period of at least two weeks, or at least four weeks, or greater than a month or greater than four months, as measured using the Floc Formation Test, described in USPA 2008/0263780 A1.

All percentages, ratios and proportions used herein are by weight percent of the composition, unless otherwise specified. All average values are calculated "by weight" of the composition, unless otherwise expressly indicated.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

The Liquid Acidic Hard Surface Cleaning Composition

The compositions according to the present invention are designed as hard surfaces cleaners. The compositions according to the present invention are liquid compositions (including gels) as opposed to a solid or a gas.

The liquid acidic hard surface cleaning compositions according to the present invention are preferably aqueous compositions. Therefore, they may comprise from 70% to 99% by weight of the total composition of water, preferably from 75% to 95% and more preferably from 80% to 95%.

The compositions herein may have a water-like viscosity. By "water-like viscosity" it is meant herein a viscosity that is close to that of water. Preferably the liquid acidic hard surface cleaning compositions herein have a viscosity of up to 50 cps at 60 rpm, more preferably from 0 cps to 30 cps, yet more preferably from 0 cps to 20 cps and most preferably from 0 cps to 10 cps at 60 rpm[1] and 20° C. when measured with a Brookfield digital viscometer model DV II, with spindle 2.

In other embodiments, the compositions herein are thickened compositions. Thus, the liquid acidic hard surface cleaning compositions herein preferably have a viscosity of from 50 cps to 5000 cps at 10 $s^{-1}$, more preferably from 50 cps to 2000 cps, yet more preferably from 50 cps to 1000 cps and most preferably from 50 cps to 500 cps at 10 $s^{-1}$ and 20° C. when measured with a Rheometer, model AR 1000 (Supplied by TA Instruments) with a 4 cm conic spindle in stainless steal, 2° angle (linear increment from 0.1 to 100 $sec^{-1}$ in max. 8 minutes). Preferably, the thickened compositions according to this specific embodiment are shear-thinning compositions. The thickened liquid acidic hard surface cleaning compositions herein preferably comprise a thickener, more preferably a polysaccharide polymer (as described herein below) as thickener, still more preferably a gum-type polysaccharide polymer thickener and most preferably Xanthan gum.

Surfactant System:

The acidic liquid hard surface cleaning composition comprises a surfactant system, wherein the surfactant system comprises: an alkyl pyrrolidone, an additional nonionic surfactant selected from the group consisting of: alkoxylated nonionic surfactant, alkyl polyglucoside, and mixtures thereof, and less than 3.5 wt % of the composition of anionic surfactant.

Alkyl Pyrrolidone:

Pyrrolidone-based surfactants, including alkyl pyrrolidones, are well known and their use and methods of making them have been extensively reviewed (for instance in Pyrrolidone-based surfactants (a literature review), Login, R. B. J Am Oil Chem Soc (1995) 72: 759-771). Such alkyl pyrrolidones have been found to provide improved soapy grease scum removal as well as water-mark removal, even when used in the alkaline hard surface cleaning compositions of the present invention.

Suitable alkyl pyrrolidones can have the formula:

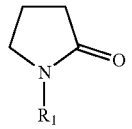

wherein $R_1$ is C6-C20 alkyl, or $R_2NHCOR_3$, and $R_2$ is C1-6 alkyl and $R_3$ is C6-20 alkyl. $R_1$ is preferably C6-C20 alkyl. N-alkyl pyrrolidones are particularly suitable for use in compositions of the present invention, with N-alkyl-2-pyrrolidones being particularly suited. Suitable alkylpyrrolidones include N-alkyl-2-pyrrolidones, wherein the alkyl chain is C6 to C20, or C6 to C10, or C8. N-octyl-2-pyrrolidone is particularly preferred for their efficacy in removing limescale based stains, even when used in alkaline compositions. The alkyl chain can be substituted, though unsubstituted alkyl pyrrolidones are preferred. The alkyl chain is preferably fully saturated.

The alkyl pyrrolidone can be present at a level of from 0.1 to 10%, preferably from 0.5 to 5%, more preferably from 1.0 to 3.0% by weight of the composition.

Suitable alkyl pyrrolidones are marketed under the tradename Surfadone® by the Ashland Inc., such as Surfadone LP-100 (N-octly-2-pyrrolidone) and LP-300 (N-docedycl-2-pyrrolidone), and is also available from BASF.

Additional Nonionic Surfactant:

The acidic hard surface cleaning composition comprises an additional nonionic surfactant selected from the group consisting of: alkoxylated nonionic surfactant, alkyl polyglucoside, and mixtures thereof.

Suitable alkoxylated nonionic surfactants include alkoxylated alcohol nonionic surfactants, which can be readily made by condensation processes which are well-known in the art. However, a great variety of such alkoxylated alcohols, especially ethoxylated and/or propoxylated alcohols, are conveniently commercially available. Surfactants catalogs are available which list a number of surfactants, including nonionics.

Preferred alkoxylated alcohols are nonionic surfactants according to the formula $RO(E)_e(P)_pH$ where R is a hydrocarbon chain of from 2 to 24 carbon atoms, E is ethylene oxide and P is propylene oxide, and e and p which represent the average degree of, respectively ethoxylation and propoxylation, are of from 0 to 24 (with the sum of e+p being at least 1). Preferably, the hydrophobic moiety of the nonionic compound can be a primary or secondary, straight or branched alcohol having from 8 to 24 carbon atoms.

Preferred additional nonionic surfactants for use in the compositions according to the invention are the condensation product of ethylene and/or propylene oxide with an alcohol having a straight alkyl chain comprising from 6 to 22 carbon atoms, wherein the degree of ethoxylation/propoxylation is from 1 to 15, preferably from 5 to 12 or mixtures thereof. Such suitable nonionic surfactants are commercially available from Shell, for instance, under the trade name Neodol® or from BASF under the trade name Lutensol®, and from Sasol under the tradename Marilpal®.

Alkyl polyglycosides are biodegradable nonionic surfactants which are well known in the art. Suitable alkyl polyglycosides can have the general formula $C_nH_{2n+1}O(C_6H_{10}O_5)_xH$ wherein n is preferably from 9 to 16, more preferably 11 to 14, and x is preferably from 1 to 2, more preferably 1.3 to 1.6. Such alkyl polyglycosides provide a good balance between anti-foam activity and detergency. Alkyl polyglycoside surfactants are commercially available in a large variety. An example of a very suitable alkyl poly glycoside product is Planteren APG 600, which is essentially an aqueous dispersion of alkyl polyglycosides wherein n is about 13 and x is about 1.4.

The additional nonionic surfactant can be present at a level of from 0.1 to 15%, preferably from 1.0 to 10%, more preferably from 2.5 to 7.5% by weight of the composition.

Anionic Surfactant:

The composition comprises limited amounts, or no anionic surfactant. As such, the hard surface composition comprises less than 1 wt %, preferably less than 0.5 wt %, more preferably less than 0.1 wt % of anionic surfactant.

If present, the anionic surfactant can be selected from the group consisting of: alkyl sulphate, alkyl alkoxylated sulphate, sulphonic acid or sulphonate surfactant, carboxylated anionic surfactant (such as those selected from the group consisting of: polycarboxylated anionic surfactants, alkyl ether carboxylates, alkyl polyglycosides ether carboxylates, and mixtures thereof), and mixtures thereof.

Additional Surfactant

The compositions of the present invention may comprise an additional surfactant, or mixtures thereof. Additional surfactants may be desired herein as they further contribute to the cleaning performance and/or shine benefit of the compositions of the present invention. Surfactants to be used herein include further nonionic surfactant, cationic surfactants, amphoteric surfactants, zwitterionic surfactants, and mixtures thereof.

Accordingly, the compositions according to the present invention may comprise up to 15% by weight of the total composition of additional surfactant or a mixture thereof.

Particularly suitable further nonionic surfactant include amine oxide surfactants.

Suitable amine oxide surfactants include: $R_1R_2R_3NO$ wherein each of $R_1$, $R_2$ and $R_3$ is independently a saturated or unsaturated, substituted or unsubstituted, linear or branched hydrocarbon chain having from 10 to 30 carbon atoms. Preferred amine oxide surfactants are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups. $R_1$ may be a saturated or unsaturated, substituted or unsubstituted linear or branched hydrocarbon chain.

A highly preferred amine oxide is $C_{12}$-$C_{14}$ dimethyl amine oxide, commercially available from Albright & Wilson, $C_{12}$-$C_{14}$ amine oxides commercially available under the trade name Genaminox® LA from Clariant or AROMOX® DMC from AKZO Nobel.

Suitable zwitterionic surfactants of use herein contain both basic and acidic groups which form an inner salt giving both cationic and anionic hydrophilic groups on the same molecule at a relatively wide range of pH's. The typical cationic group is a quaternary ammonium group, although other positively charged groups like phosphonium, imidazolium and sulfonium groups can be used. The typical anionic hydrophilic groups are carboxylates and sulfonates, although other groups like sulfates, phosphonates, and the like can be used.

Some common examples of zwitterionic surfactants (i.e. betaine/sulphobetaine) are described in U.S. Pat. Nos. 2,082,275, 2,702,279 and 2,255,082.

For example Coconut dimethyl betaine is commercially available from Seppic under the trade name of Amonyl 265@. Lauryl betaine is commercially available from Albright & Wilson under the trade name Empigen BB/L®. A further example of betaine is Lauryl-immino-dipropionate commercially available from Rhodia under the trade name Mirataine H2C-HA®.

Particularly preferred zwitterionic surfactants for use in the compositions of the present invention are the sulfobetaine surfactants as they deliver optimum soap scum cleaning benefits.

Examples of particularly suitable sulfobetaine surfactants include tallow bis(hydroxyethyl) sulphobetaine, cocoamido propyl hydroxy sulphobetaines which are commercially available from Rhodia and Witco, under the trade name of Mirataine CBS® and Rewoteric AM CAS 15® respectively.

Amphoteric and ampholytic detergents which can be either cationic or anionic depending upon the pH of the system are represented by detergents such as dodecylbetaalanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378. Additional synthetic detergents and listings of their commercial sources can be found in McCutcheon's Detergents and Emulsifiers, North American Ed. 1980.

Cationic surfactants suitable for use in compositions of the present invention are those having a long-chain hydrocarbyl group. Examples of such cationic surfactants include the quaternary ammonium surfactants such as alkyldimethylammonium halogenides. Other cationic surfactants useful herein are also described in U.S. Pat. No. 4,228,044, Cambre, issued Oct. 14, 1980.

The Organic Acid System

The liquid compositions of the present invention are acidic. Therefore they have a pH of from 1.5 to less than 7. Certain lesser grade chrome finishing and stainless steels can be prone to pitting in highly acidic conditions. As such, the composition preferably has a pH of from 1.8 to 6, preferably 2.0 to 4.0, even more preferably 2.1 to 3.5, measured at 25° C.

The composition comprises an organic acid system, for improved safety on such chromed surfaces and stainless steel surfaces. Typically, the acid system comprises any organic acid well-known to those skilled in the art, or a mixture thereof. In preferred embodiments, the organic acid system comprises acids selected from the group consisting of: citric acid, formic acid, acetic acid, maleic acid, lactic acid, glycolic acid, oxalic acid, succinic acid, glutaric acid, adipic acid, methansulphonic acid, and mixtures thereof, more preferably citric acid, formic acid, acetic acid, and mixtures thereof.

The composition preferably comprises the acid system at a level of from 0.01% to 15%, preferably from 0.5% to 10%, more preferably from 1.0% to 6.0%, most preferably from 1.5% to 5.0% by weight of the total composition. The weight percentages are measured according to the added amounts of the acid, before any in-situ neutralization.

Formic acid has been found to provide excellent limescale removal performance, in combination with improved surface safety, especially for surfaces which are prone to corrosion. For improved surface safety, especially of more delicate surfaces, the composition preferably comprises formic acid as part of the acid system. In order to achieve the desired pH, the compositions of the present invention may comprise from 0.01% to 15%, preferably from 0.5% to 10%, more preferably from 1% to 8%, even more preferably from 1% to 6%, still more preferably 1% to 4%, yet more preferably 1% to 3%, yet still more preferably 2% to 3% by weight of the total composition of formic acid.

Lactic acid can be used as part of the acid system, especially where antimicrobial or disinfecting benefits are desired. Such compositions may comprise up to 10% by weight of the total composition of lactic acid, preferably from 0.1% to 6%, more preferably from 0.2% to 4%, even more preferably from 0.2% to 3%, and most preferably from 0.5% to 2%.

The compositions of the present invention may comprise from 0.1 to 30%, preferably from 2% to 20%, more preferably from 3% to 15%, most preferably from 3% to 10% by weight of the total composition of acetic acid. Alternatively, the compositions of the present invention may comprise from 0.1 to 5%, preferably from 0.1% to 3%, more preferably from 0.1% to 2%, most preferably from 0.5% to 2% by weight of the total composition of acetic acid.

The compositions of the present invention may comprise from 0.1 to 30%, preferably from 1% to 20%, more preferably from 1.5% to 15%, most preferably from 1.5% to 10% by weight of the total composition of citric acid.

The compositions herein can comprise an alkaline material. The alkaline material may be present to trim the pH and/or maintain the pH of the compositions according to the present invention. Examples of alkaline material are sodium hydroxide, potassium hydroxide and/or lithium hydroxide, and/or the alkali metal oxides such, as sodium and/or potassium oxide or mixtures thereof and/or monoethanolamine and/or triethanolamine Other suitable bases include ammonia, ammonium carbonate, choline base, etc. Preferably, source of alkalinity is sodium hydroxide or potassium hydroxide, preferably sodium hydroxide.

Typically the amount of alkaline material is of from 0.001% to 20% by weight, preferably from 0.01% to 10% and more preferably from 0.05% to 3% by weight of the composition.

The composition preferably comprises less than 0.08%, more preferably less than 0.05%, more preferably less than 0.005% of phosphoric acid. In the most preferred embodiments, the composition comprises no phosphoric acid. Such compositions can provide improved surface safety in addition to an improved environmental profile.

Despite the presence of alkaline material, if any, the compositions herein would remain acidic compositions.

Optional Ingredients

The compositions according to the present invention may comprise a variety of optional ingredients depending on the technical benefit aimed for and the surface treated.

Suitable optional ingredients of use herein include other acids, thickeners, chelating agents, surface modification polymer, radical scavengers, perfumes, solvents, other surfactants, builders, buffers, antimicrobial agents, hydrotropes, colorants, stabilizers, bleaches, bleach activators, suds controlling agents like fatty acids, enzymes, soil suspenders, brighteners, dispersants, pigments, and dyes.

Other Acids:

Suitable other acids include inorganic acids, such as hydrochloric acid, sulphurinc acid, sulphamic acid, and the like.

Thickener:

Preferred thickeners are anionic polymeric thickener, more preferably xanthan gum. Surprisingly, anionic polymeric thickeners can be used to achieve the desired composition viscosity, even though the copolymers comprise cationic monomeric units (monomer B).

Preferred anionic polymeric thickeners are polysaccharide polymers. As such, the compositions of the present invention may optionally comprise a polysaccharide polymer or a mixture thereof. Typically, the compositions of the present invention may comprise from 0.01% to 5% by weight of the total composition of a polysaccharide polymer or a mixture thereof, more preferably from 0.05% to 3% and most preferably from 0.05% to 1%.

Preferably, the compositions of the present invention comprise a polysaccharide polymer selected from the group consisting of: carboxymethylcellulose, ethyl cellulose, hydroxyethyl cellulose, hydroxypropyl cellulose, hydroxymethyl cellulose, succinoglycan gum, xanthan gum, gellan gum, guar gum, locust bean gum, tragacanth gum, derivatives of the aforementioned, and mixtures thereof. Preferably, the compositions herein comprise a polysaccharide polymer selected from the group consisting of: succinoglycan gum, xanthan gum, gellan gum, guar gum, locust bean gum, tragacanth gum, derivatives of the aforementioned, and mixtures thereof. More preferably, the compositions herein comprise a polysaccharide polymer selected from the group consisting of: xanthan gum, gellan gum, guar gum, derivatives of the aforementioned, and mixtures thereof. Most preferably, the compositions herein comprise xanthan gum, derivatives thereof, and mixtures thereof.

Xanthan gum and derivatives thereof may be commercially available for instance from CP Kelco under the trade name Keltrol RD®, Kelzan S® or Kelzan T®. Other suitable xanthan gums are commercially available by Rhodia under the trade name Rhodopol T® and Rhodigel X747®. Succinoglycan gum of use herein is commercially available by Rhodia under the trade name Rheozan®.

Antimicrobial Agent:

The composition can comprise an antimicrobial agent. Such antimicrobial agents can provide the desired degree of antimicrobial efficacy when the acidity of the composition is insufficient. For instance, when the composition is diluted before use.

Suitable antimicrobial agents can be selected from the group consisting of: quaternary ammonium compounds, lactic acid, oxalic acid, and mixtures thereof; more preferably a quaternary ammonium compound which is selected from the group consisting of: didecyl dimethyl ammonium chloride, alkyl dimethyl benzyl ammonium chloride, alkyl dimethyl ethylbenzyl ammonium chloride, and mixtures thereof.

Suitable antimicrobial agents include cationic antimicrobial agents, such as quaternary ammonium compounds. Preferred quaternary ammonium compounds are those of the formula:

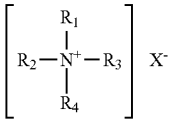

wherein at least one of $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of at least 165. The hydrophobic radical-s may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical, and preferably aids in the solubilization of the quaternary ammonium germicide in water. X can be a halide, for example a chloride, bromide or iodide, or X can be a methosulfate counterion, or X can be a carbonate ion.

Exemplary quaternary ammonium compounds include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium compounds include those in which the molecule contains either amide or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

More preferred quaternary ammonium compounds used in the compositions of the invention include those of the structural formula:

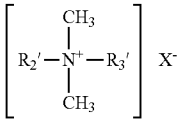

wherein $R_2'$ and $R_3'$ may be the same or different and are selected from C8-C12 alkyl, or $R_2'$ is C12-C16 alkyl, C8-C18 alkylethoxy, C8-C18 alkylphenolethoxy and $R_3'$ is benzyl, and X is a halide, for example a chloride, bromide or iodide, or X is a methosulfate counterion. The alkyl groups recited in $R_2'$ and $R_3'$ may be linear or branched, but are preferably substantially linear, or fully linear.

Particularly useful quaternary germicides include compositions presently commercially available under the tradenames BARDAC, BARQUAT, BTC, and HYAMINE. These quaternary ammonium compounds are usually provided in a solvent, such as a C2 to C6 alcohol (such as ethanol, n-propanol, isopropanol, n-butanol, sec-butanol, and the like), glycols such as ethylene glycol, or in mixtures containing water, such alcohols, and such glycols. Particularly preferred is didecyl dimethyl ammonium chloride, such as supplied by Lonza under tradenames such as: Bardac 2250™, Bardac 2270™, Bardac 2270E™, Bardac 2280™, and/or a blend of alkyl, preferably C12-C18, dimethyl benzyl ammonium chloride and alkyl, preferably C12-C18, dimethyl ethylbenzyl ammonium chloride, such as supplied by Lonza under the brand names: Barquat 4280Z™. In preferred embodiments, the alkyl dimethyl benzyl ammonium chloride and alkyl dimethyl ethylbenzyl ammonium chloride are present in a ratio of from 20:80 to 80:20, or 40:60 to 60:40, with a ratio of 50:50 being the most preferred.

Other suitable, but less preferred, antimicrobial agents include germicidal amines, particularly germicidal triamines such as LONZA-BAC 12, (ex. Lonza, Inc., Fairlawn, N.J. and/or from Stepan Co., Northfield Ill., as well as other sources).

In the cleaning compositions according to the invention, the antimicrobial agent, preferably quaternary ammonium compound, is required to be present in amounts which are effective in exhibiting satisfactory germicidal activity against selected bacteria sought to be treated by the cleaning compositions. Such efficacy may be achieved against less resistant bacterial strains with only minor amounts of the quaternary ammonium compounds being present, while more resistant strains of bacteria require greater amounts of the quaternary ammonium compounds in order to destroy these more resistant strains.

The antimicrobial agent need only be present in germicidally effective amounts, which can be as little as 0.001 wt % to less than 2% by weight of the composition. In more preferred compositions, the hard surface cleaning composition comprises the antimicrobial agent at a level of from 0.005% to 1.8%, preferably from 0.008% to 1.2%, preferably from 0.01% to 0.8%, preferably from 0.05% to 0.5%% by weight of the composition.

A germicidally effective amount of the antimicrobial agent typically results in at least a log 4, preferably at least a log 5 reduction of *Staphylococcus aureus*, using the method of EN1276 (Chemical Disinfectants Bactericidal Activity Testing), in 3 minutes.

Surface Modification Polymers

Surface modification polymers can be added in order to provide improved shine over a wider range of surfaces, and/or easier next time cleaning, or another benefit.

Suitable surface modification polymers can be selected from the group consisting of: a vinylpyrrolidone homopolymer (PVP); a polyethyleneglycol dimethylether (DMPEG); a vinylpyrrolidone/dialkylaminoalkyl acrylate or methacrylate copolymers; a polystyrenesulphonate polymer (PSS); a poly vinyl pyridine-N-oxide (PVNO); a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; a polyethyleneimine polymer such as carboxylated polyethyleineimine; a copolymer of Zea mays (corn) starch, acrylic acid and acrylamidopropyltrimethylammonium chloride monomers (polyquaternium-95) and mixtures thereof.

Suitable vinylpyrrolidone homopolymers of use herein are homopolymers of N-vinylpyrrolidone having the following repeating monomer:

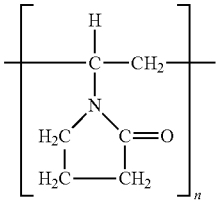

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") of use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15 ® (viscosity molecular weight of 10,000), PVP K-30® (average molecular weight of 40,000), PVP K-60® (average molecular weight of 160,000), and PVP K-90® (average molecular weight of 360,000). Other suitable vinylpyrrolidone homopolymers which are commercially available from BASF Cooperation include Sokalan HP 165®, Sokalan HP 12®, Luviskol K30®, Luviskol K60®, Luviskol K80®, Luviskol K90®; vinylpyrrolidone homopolymers known to persons skilled in the detergent field (see for example EP-A-262,897 and EP-A-256,696).

Suitable polyethyleneimine polymers include carboxylated polyethyleineimines. Suitable modified polyethyleineimines may be linear or branched, charged or uncharged. They may be hyperbranched or have a dendritic form. They may contain primary, secondary, and/or tertiary amino groups. They are carboxylated by reaction with fatty acids, carboxylic acid and/or carboxylic acid derivatives (such as acrylic acid, maleic acid, maleic anhydride, etc.). They may be alkoxylated, amidated, etc. They may be amphiphilic, amphoteric, alkoxylated, etc. In some embodiments, they may have molecular weights of from about 300 to about 2,000,000. Examples of suitable modified polyethyleineimines include materials sold by BASF under the trade name Lupasol® and by Nippon Shokubai under the trade name EPOMIN. Examples include Lupasol® FG, Lupasol® G 20, Lupasol® G 35, Lupasol® G 100, Lupasol® G 500, Lupasol® HF, Lupasol® P, Lupasol® PS, Lupasol® PR 8515, Lupasol® WF, Lupasol® FC, Lupasol® PE, Lupasol® HEO 1, Lupasol® PN 50, Lupasol® PN 60, Lupasol® PO 100, Lupasol® SK, etc.

Suitable polyquaternium-95 copolymers are sold by BASF under the tradename Polyquart® EcoClean.

Typically, the liquid hard surface cleaning composition may comprise from 0.005% to 5.0% by weight of the total composition of said polymer, preferably from 0.01% to 4.0%, more preferably from 0.1% to 3.0% and most preferably from 0.20% to 1.0%.

According to a very preferred execution of the present invention, vinylpyrrolidone homopolymers, polyquaternium-95, and polyethyleneimine polymers are advantageously selected.

Chelating Agent

The liquid hard surface cleaning composition can comprise a chelating agent or crystal growth inhibitor. Chelating agents can be incorporated in the compositions herein in amounts ranging up to 10% by weight of the total composition, preferably 0.01% to 5.0%, more preferably 0.05% to 1%.

Suitable chelating agents, in combination with the surfactant system, improve the shine benefit. The addition of a chelant, especially chelants selected from the group consisting of: amino-carboxylates (such as diethylenetriaminepentaacetic acid [DTPA]), phosphonate chelating agents, and mixtures thereof, surprisingly improve greasy soap scum and water-mark removal as well as shine from the treated surface.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). diethylene triamine penta methylene phosphonate (DTPMP), ethane 1-hydroxy diphosphonate (HEDP), and mixtures thereof, are preferred. Such phosphonate chelating agents are commercially available from Monsanto under the trade name DEQUEST®. The phosphonate compounds may be present either in their acid form or as salts of different cations on some or all of their acid functionalities. The phosphonate compounds may be present either in their acid form or as salts of different cations on some or all of their acid functionalities.

Other suitable phosphonate chelating agents include:

a) water-soluble organic phosphonic acids or salts thereof having the formula:

$R_1N[CH_2PO_3H_2]_2$, wherein $R_1$ is *a:*

[(lower)alkyl]$N[CH_2PO_3H_2]_2$ or salt thereof, or

[(lower)alkyl]$N[CH_2PO_3H_2]$[(lower)alkylene]N $[CH_2PO_3H_2]_2$ or salt thereof, or $[CH_2PO_3H_2]$ moiety or salt thereof;

b) phosphonocarboxylic acids, or salts thereof, including those of formula (A) and (B):

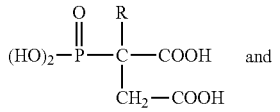

(A)

and

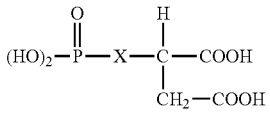

(B)

wherein R is hydrogen, alkyl, alkenyl, or alkynyl radical having 1 to 4 carbon atoms, an aryl, cycloalkyl, or aralkyl radical, or the radical selected from the following:

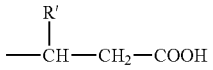

and

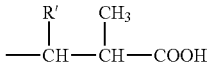

wherein R' is hydrogen, alkyl radical of 1 to 4 carbon atoms, or a carboxyl radical;

and X is selected from the following:

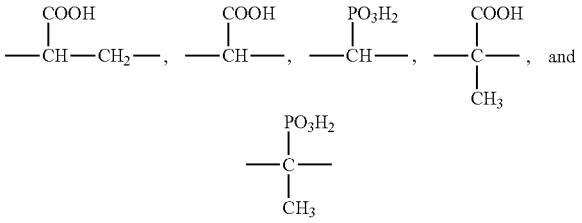

wherein the —$PO_3H_2$ group is the phosphono group:

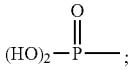

Such phosphonate chelating agents are described in EP17150033.3.

A preferred biodegradable chelating agent of use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename (S,S)EDDS® from Palmer Research Laboratories. Most preferred biodegradable chelating agent is L-glutamic acid N,N-diacetic acid (GLDA) commercially available under tradename Dissolvine 47S from Akzo Nobel.

Amino carboxylates of use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF. Further carboxylate chelating agents of use herein include salicylic acid, aspartic acid, glutamic acid, glycine, malonic acid or mixtures thereof.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

Further carboxylate chelating agents to be used herein include salicylic acid, aspartic acid, glutamic acid, glycine, malonic acid or mixtures thereof.

Solvent

The compositions of the present invention may further comprise a solvent or a mixture thereof, as an optional ingredient. Solvents to be used herein include all those known to those skilled in the art of hard-surfaces cleaner compositions. In a highly preferred embodiment, the compositions herein comprise an alkoxylated glycol ether (such as n-Butoxy Propoxy Propanol (n-BPP)) or a mixture thereof.

Typically, the compositions of the present invention may comprise from 0.1% to 5% by weight of the total composition of a solvent or mixtures thereof, preferably from 0.5% to 5% by weight of the total composition and more preferably from 1% to 3% by weight of the total composition.

Wipe or Pad

The composition described herein can be comprised in a spray dispenser, or in a wipe or pad. Suitable wipes can be fibrous. Suitable fibrous wipes can comprise polymeric fibres, cellulose fibres, and combinations thereof. Suitable cellulose-based wipes include kitchen wipes, and the like. Suitable polymeric fibres include polyethylene, polyester, and the like. Polymeric fibres can be spun-bonded to form the wipe. Methods for preparing thermally bonded fibrous materials are described in U.S. application Ser. No. 08/479,096 (Richards et al.), filed Jul. 3, 1995 (see especially pages 16-20) and U.S. Pat. No. 5,549,589 (Homey et al.), issued Aug. 27, 1996 (see especially Columns 9 to 10). Suitable pads include foams and the like, such as HIPE-derived hydrophilic, polymeric foam. Such foams and methods for their preparation are described in U.S. Pat. No. 5,550,167 (DesMarais), issued Aug. 27, 1996; and commonly assigned U.S. patent application Ser. No. 08/370,695 (Stone et al.), filed Jan. 10, 1995.

The Process of Cleaning a Hard-Surface or an Object

The acidic compositions described herein, are suitable for removing grease residues from hard surfaces, in addition to limescale. Grease residues which are effectively removed by the compositions include oils, grease, and polymerized grease, such as those typically found in the kitchen, in addition to greasy soap scum which is typically found in bathrooms and the like.

The preferred process of cleaning a hard-surface or an object (preferably removing limescale from said hard-surface or said object) comprises the step of applying a composition according to the present invention onto said hard surface, leaving said composition on said surface, preferably for an effective amount of time, more preferably for a period comprised between 10 seconds and 10 minutes, most preferably for a period comprised between 15 seconds and 4 minutes; optionally wiping said hard-surface or object with an appropriate instrument, e.g. a sponge; and then preferably rinsing said surface with water.

The hard surface may be wiped after application of the composition to the hard surface to remove more of the residues from the surface.

The compositions of the present invention may be contacted to the surface to be treated in its neat form or in its diluted form. When used in diluted form, the acidic liquid hard surface cleaning composition may be diluted to a level of from 0.1% to 2.0%, or from 0.3% to 1.5% by volume. The composition may be diluted to a level of from 0.4% to 0.6% by volume, especially when the composition has a total surfactant level of greater than or equal to 5% by weight. Where the composition has a total surfactant level of less than 5% by weight, the composition may be diluted to a level of from 0.7% to 1.4% by volume. In preferred embodiments, the composition is diluted with water.

The dilution level is expressed as a percent defined as the fraction of the alkaline liquid hard surface cleaning composition, by volume, with respect to the total amount of the diluted composition. For example, a dilution level of 5% by volume is equivalent to 50 ml of the composition being diluted to form 1000 ml of diluted composition.

The diluted composition can be applied by any suitable means, including using a mop, sponge, cloth, wipe, pad, or other suitable implement.

The compositions according to the present invention are particularly suitable for treating hard-surfaces located in and around the house, such as in bathrooms, toilets, garages, on driveways, basements, gardens, kitchens, etc., and preferably in bathrooms. It is however known that such surfaces (especially bathroom surfaces) may be soiled by the so-called "limescale-containing soils". By "limescale-containing soils" it is meant herein any soil which contains not only limescale mineral deposits, such as calcium and/or magnesium carbonate, but also soap scum (e.g., calcium stearate) and other grease (e.g. body grease). By "limescale deposits" it is mean herein any pure limescale soil, i.e., any soil or stains composed essentially of mineral deposits, such as calcium and/or magnesium carbonate.

The compositions herein may be packaged in any suitable container, such as bottles, preferably plastic bottles, optionally equipped with an electrical or manual trigger spray-head.

Methods:

A) pH Measurement:

The pH is measured on the neat composition, at 25° C., using a Sartarius PT-10P pH meter with gel-filled probe (such as the Toledo probe, part number 52 000 100), calibrated according to the instructions manual.

B) Greasy Soap Scum Removal:

White enamel tiles (7 cm×25 cm, supplied by Emaillerie Belge SA) are used in this method. The tiles are soaked in a diluted All Purpose Cleaning composition which is free of surface modification polymers (such as current market European Mr. Propre APC liquid diluted to 2.4 volume %) overnight and rinsed thoroughly the day after with demineralised water to remove all product residues. The tiles are then completely dried.

Greasy soap scum is prepared by adding 18 g of Artificial Body Soil produced (ABS, supplied by Empirical Manufacturing Company, 7616 Reinhold drive, Cincinnati Ohio 45237 USA) to 240 g of isopropanol, under rapid stirring, before slowly adding 27 g of calcium stearate and then 2.4 g of House Wife Soil with Carbon Black ("HWS", supplied by Warwick Equest Limited, Consett Business Park, 55, Consett DH8 6BN, United Kingdom), and then stirring for 30 minutes while sealed.

The greasy soap scum suspension is then uniformly sprayed onto the enamel tiles using a manual sprayer until 0.3+/−0.5 g of the greasy soap scum (weight after evaporation of the isopropanol) is applied uniformly to each tile. The tiles are placed, flat, in an oven preheated to 140° C. for 30 minutes to evaporate off the isopropanol. If the mass of greasy soap scum on the tile, after evaporation of the isopropanol, is not in the range 0.3+/−0.5 g the tile is discarded and a new tile is prepared using the above procedure.

ENKA Z sponges (16 cm×12 cm yellow viscose sponges, reinforced with cotton, sold by Vileda) are washed 3 times in a washing machine at 96° C. (nil-detergent). Four sponges having a size of 9.0 cm×4.0 cm are cut from the ENKA Z sponges, and then rinsed under running water and squeezed dry. The weight of the four squeezed sponge should be the same (+/−2 g). 5 ml of the test liquid hard surface cleaning composition are applied to the sponge using a pipette.

Applying uniform pressure of 1.4 $kN/m^2$, wipe the tile in a linear motion over the tile at a frequency of 20 strokes per minute. This is preferably done using a mechanical apparatus which applies uniform pressure while wiping over the tile length at the defined number of cycles per minute. The number of strokes required to clean the tile is counted. The cleaning test is repeated at least eight times and the result averaged.

The grease soap scum removal index is calculated relative to the reference as follows:

$$\frac{\text{Av. number of strokes to clean the tile using the composition}}{\text{Av. number of strokes to clean the tile using the reference composition}} \times 100$$

Hence, a lower grade indicates improved polymerized grease cleaning.

C) Shine:

The shine test is done with a soil mixture which consists of a mixture of consumer relevant soils such as oil, polymerized oil, particulates, pet hair, granulated sugar etc. The black glossy ceramic tiles (Black Glossy Sphinx ceramic tiles 20×25 cm, Ref H07300, available at Carobati, Boomsesteenweg 36, 2630 Aartselaar www.carobati.be) are soiled with 0.03 g soil mixture (18.01 wt % Crisco oil [purchased from a North American supermarket], 2.08 wt % of polymerized Crisco oil [polymerized by pumping air at 1 PSI (0.0689 bar) through 500 g of Crisco oil in a 2 L beaker, while stirring at 125 rpm on a hot-plate set at 204° C. for 67 hours, before covering with an aluminium foil and leaving at 204° C. for an additional 30 hours, then cooling to room temperature with hot-plate turned off for 64 hours before heating at 204° C. for 64 hours, before cooling at room temperature with the hot-plate turned off for an additional 24 hours, so that the final viscosity of the oil is between 1800 and 2200 cps, when measured using a Brookfield DVT with spindle nr. 31 at 6 rpm], 28.87 wt % of granulated sugar, and 51.04 wt % of vacuum cleaner soil ["Vacuum Cleaner Soil" supplied by Chem-Pack, 2261 Spring Grove Avenue, Cincinnati Ohio 45214 USA]) by blending the soil mixture with isopropyl alcohol at 1.45 wt % and spraying onto the tile.

The tiles are then cleaned with the liquid hard surface cleaning composition which has been diluted to a level of 0.48 wt % using water having a hardness of 0.93 mmol/1, using a non-woven cloth soaked in the diluted cleaning solution, and wiping first horizontally, then vertically, and then again horizontally. The cloth is then rinsed in the diluted liquid hard surface cleaning composition, and the tiles cleaned in the same manner, using the other side of the nonwoven cloth.

After letting the tiles dry, the tiles are then graded using the grading scale described below, versus tiles cleaned using the reference composition. A positive value means improved shine versus the reference, a negative value means worse shine versus the reference.

Shine grading scale: (average of 3 graders, each grading 2 sets of tiles per product comparison, for a total of six gradings):

0=I see no difference
1=I think there is difference
2=I am sure there is a slight difference
3=I am sure there is a difference
4=I am sure there is a big difference The shine gradings were averaged to provide the final shine grading.

D) Grease Removal Test:

White enamel tiles (7 cm×25 cm, supplied by Emaillerie Belge SA) are used in this method. The tiles are soaked in a diluted All Purpose Cleaning composition which is free of surface modification polymers (such as current market European Mr. Propre APC liquid diluted to 2.4 volume %) overnight and rinsed thoroughly the day after with demineralised water to remove all product residues. The tiles are then completely dried.

In order to provide the soil mix, mix 24.5 g of oil mix (by weight, ⅓ peanut oil, ⅓ sunflower oil, ⅓ corn oil of Belgian brand 'Vandemoortele') and 0.5 g of HSW (Housewife Soil with Carbon Black supplied by Chem-Pack, 2261 Spring Grove Avenue, Cincinnati Ohio 45214 USA) in a 50 mL beaker for 15 minutes using a magnetic stirrer to ensure a homogeneous mixture.

Weigh each tile. Cut out the edge of a 7 ml pipette and sample around 3 to 4 ml of the soil mix. Pour the soil mix evenly onto 10 tiles. Repeat twice the sampling and pouring of soil mix. Without squeezing, brush a paint roller (7 cm length, 6 cm diameter, made from synthetic sponge) to remove any remaining particles. With firm pressure, roll the soil in a vertical motion over the tile, then roll horizontally over the tiles. Finish with a gentle vertical roll to ensure the soil has evenly spread. Weigh each tile again and calculate the difference in mass in order to find the weight of soil mix applied to each tile. The total mass of soil mix per tile must be 0.6 g+/−0.1 g. If less than 0.5 g, add soil mix and roll once more to form a thin even layer. If the mass of soil mix per tile is greater than 0.7 g, start all over using a new tile.

Preheat an oven to 135° C. for enamel Use a temperature probe to monitor the temperature of the oven. Start a timer when the oven reaches again 135° C. for enamel. The soil mix is polymerized by baking the tiles at 135° C. for 2 hours. Once the baking time has been reached, remove the tiles from the oven and cool them overnight in a controlled temperature/humidity cabinet (25° C./70% relative humidity).

Rinse sponges (yellow cellulose sponges. Type Z, supplied by Boma, Noorderlaan 131, 2030 Antwerpen) under running tap city water and squeeze out. The weight of the four squeezed sponge should be the same (+/−2 g). Pour 5 ml of liquid hard surface cleaning composition with a pipette onto the sponge.

Applying uniform pressure, wipe the tile in a linear motion over the tile at a frequency of 20 strokes per minute. This is preferably done using a mechanical apparatus which applies uniform pressure while wiping over the tile length at the defined number of cycles per minute. The number of strokes required to clean the tile is counted. The cleaning test is repeated at least eight times and the result averaged.

The cleaning index is calculated relative to the reference as follows:

$$\frac{Av.\ \text{number of strokes to clean the tile using the composition}}{Av.\ \text{number of strokes to clean the tile using the reference composition}} \times 100$$

Examples

The following compositions were made by simple mixing:

| | Ex A* wt % | Ex 1 wt % | Ex B* wt % | Ex 2 wt % |
|---|---|---|---|---|
| C9/11 EO8[1] | 6.00 | 6.00 | 6.00 | 6.00 |
| Citric acid | 1.00 | 1.00 | 1.00 | 1.00 |
| Lactic acid | 0.36 | 0.36 | 0.36 | 0.36 |
| N-Octyl-2-Pyrrolidone[2] | 0 | 2.00 | 0 | 2.00 |
| Perfume | 0.36 | 0.36 | 0.36 | 0.36 |
| Didecyl dimethyl ammonium chloride[3] | 0 | 0 | 0.5 | 0.5 |
| Sodium hydroxide | To pH 2.5 | To pH 2.5 | To pH 2.5 | To pH 2.5 |
| Grease removal | 100** | 254 s | 100** | 299 s |
| Greasy soap scum removal | 100** | 119 s | 100** | 119 s |

*Comparative

**Reference

[1]nonionic surfactant commercially available from Shell

[2]supplied under the trade name Surfadone ™ LP-100 by Ashland

[3]supplied under the trade name Bardac ™ 2280 by Lonza

As can be seen from the comparing the grease removal results from example 1 with comparative example A, adding an alkyl pyrrolidone surfactant resulted in a substantial improvement in grease removal from the acidic hard surface cleaning composition. As can be seen from the comparing the grease removal results from example 2 with comparative example B, the improvement in grease removal is also evident for acidic hard surface cleaning compositions which comprise an antimicrobial agent.

The following compositions were made by simple mixing:

| | Ex 3 wt % | Ex 4 wt % | Ex 5 wt % | Ex 6 wt % |
|---|---|---|---|---|
| C9/11 EO8[1] | 6.00 | 6.00 | 6.00 | 6.00 |
| Citric acid | 1.76 | 1.76 | 1.76 | 1.76 |
| Lactic acid | 0.64 | 0.64 | 0.64 | 0.64 |
| n-BPP | 4.8 | 4.8 | 4.8 | 4.8 |
| N-Octyl-2-Pyrrolidone[2] | 1.5 | 1.5 | 1.5 | 1.5 |
| Polyethyleneimine polymer[4] | 0 | 0.2 | 0 | 0.3 |
| Perfume | 0.36 | 0.36 | 0.36 | 0.36 |
| Didecyl dimethyl ammonium chloride[3] | 0 | 0 | 0.5 | 0.5 |
| Sodium hydroxide | To pH 2.5 | To pH 2.5 | To pH 2.5 | To pH 2.5 |
| Shine grading | Ref | +2.5 | Ref | +2.5 |

[4]carboxylated polyethyleneimine, supplied under the tradename of Lupasol ™ PN60 by BASF As can be seen from the comparing the shine results from example 4 with example 3, adding a polyethyleneimine polymer results in an improvement in shine from the acidic hard surface cleaning composition. As can be seen from the comparing the shine results from example 6 with example 5, the improvement in shine is even evident for acidic hard surface cleaning compositions which comprise an antimicrobial agent.

The following are further examples of the present invention:

| | Ex 7 wt % | Ex 8 wt % | Ex 9 wt % | Ex 10 wt % | Ex 11 wt % | Ex 12 wt % |
|---|---|---|---|---|---|---|
| C10 EO8 | — | 3 | 5.0 | — | 2.0 | — |
| Lutensol XL140 | — | 3 | — | — | — | — |
| Glucopon 225 DK | 4.0 | — | — | — | 2.0 | — |
| APG 325 M | — | — | — | — | — | 3.0 |
| C10-12 Alcohol Ethoxylate | — | — | — | 5.7 | — | — |
| C12-14 Amine oxide | — | 1 | | — | 0.5 | — |
| Cocoamidopropylbetaine | — | — | 1.5 | — | — | — |
| Glycolic acid | 1.4 | — | | 1.75 | — | 1.0 |
| Formic acid | — | — | 1.0 | — | — | — |
| Citric acid | — | 3.0 | 2.2 | — | 1.5 | 1.0 |
| Lactic acid | 0.5 | — | — | — | 1.0 | — |
| N-Octyl-2-Pyrrolidone | 2.5 | 1.5 | 2.0 | 1.0 | 1.75 | 1.0 |
| Sodium lauryl sulphate | 0.5 | — | — | — | — | — |
| Sodium Lauryl Ether sulphate | — | — | — | — | — | 2.5 |
| Sodium dodecyl benzene sulfonate | — | — | — | 0.75 | — | — |
| HLAS | — | — | 0.5 | — | — | — |
| N-BPP | — | 2.4 | — | — | — | — |
| Phenoxy isopropanol | 1.5 | — | — | — | — | — |
| Butoxyethanol | — | — | — | — | 1.0 | — |
| Benzalkonium Chloride | — | — | — | — | 0.3 | — |
| HEDP | — | 0.15 | — | — | — | 0.20 |
| Xanthan gum | — | — | | 0.3 | — | 0.25 |
| NaOH to pH | 2.1 | 2.8 | 4.0 | 2.2 | 2.5 | 3.0 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An acidic liquid hard surface cleaning composition comprising:

a surfactant system comprising:

from 1% to 5% of a C5-C12 alkyl pyrrolidone by weight of the acidic liquid hard surface cleaning composition, an additional nonionic surfactant selected from the group consisting of: alkoxylated nonionic surfactant, alkyl polyglucoside, and mixtures thereof, and less than 1.0% anionic surfactant by weight of the acidic liquid hard surface cleaning composition;

an organic acid system selected from the group consisting of: glycolic acid, citric acid, formic acid, lactic acid, acetic acid, and mixtures thereof;

from 0.005% to 5.0% carboxylated polyethyleineimine polymer by weight of the acidic liquid hard surface cleaning composition; and from 0.05% to less than 2% antimicrobial quaternary ammonium compound by weight of the acidic liquid hard surface cleaning composition, wherein:

the antimicrobial quaternary ammonium compound is selected from the group consisting of didecyl dimethyl ammonium chloride, alkyl dimethyl benzyl ammonium chloride, alkyl dimethyl ethylbenzyl ammonium chloride, and mixtures thereof, and the acidic liquid hard surface cleaning composition has a pH of from 2.0 to less than 4.0, measured on the neat acidic liquid hard surface cleaning composition, at 25° C.

2. The acidic liquid hard surface cleaning composition according to claim 1, wherein the additional nonionic surfactant is an alkoxylated nonionic surfactant, and wherein the degree of ethoxylation/propoxylation is from 1 to 15 or mixtures thereof.

3. The acidic liquid hard surface cleaning composition according to claim 2, wherein the alkoxylated nonionic surfactant is a condensation product of ethylene and/or propylene oxide with an alcohol having a straight alkyl chain comprising from 6 to 22 carbon atoms.

4. The acidic liquid hard surface cleaning composition according to claim 1, wherein the additional nonionic surfactant is present at a level of from 1 to 10% by weight of the acidic liquid hard surface cleaning composition.

5. The acidic liquid hard surface cleaning composition according to claim 1, wherein the organic acid system is selected from the group consisting of citric acid, formic acid, lactic acid, acetic acid, and mixtures thereof.

6. The acidic liquid hard surface cleaning composition according to claim 4, wherein the organic acid system is present at a level of from 1.5% to 15% by weight of the total acidic liquid hard surface cleaning composition.

7. The acidic liquid hard surface cleaning composition according to claim 1, wherein the antimicrobial quaternary ammonium compound is present at a level of from 0.05% to 1.2% by weight of the acidic liquid hard surface cleaning composition.

8. The acidic liquid hard surface cleaning composition according to claim 1, wherein the composition comprises less than 0.08% of phosphoric acid.

9. A method of cleaning a hard surface comprising the step of applying an acidic hard surface cleaning composition according to claim 1 to the hard surface.

10. The acidic liquid hard surface cleaning composition according to claim 1:

comprising from 1% to 3% of a C5-C12 alkyl pyrrolidone by weight of the acidic liquid hard surface cleaning composition;

comprising from 0.05% to 1.2% antimicrobial quaternary ammonium compound by weight of the acidic liquid hard surface cleaning composition; and wherein the organic acid system is selected from the group consisting of citric acid, lactic acid, and mixtures thereof.

* * * * *